US007004654B2

(12) United States Patent
Shibata et al.

(10) Patent No.: US 7,004,654 B2
(45) Date of Patent: Feb. 28, 2006

(54) TAPE PRINTER

(75) Inventors: Yasuhiro Shibata, Okazaki (JP); Naruhito Muto, Ama-gun (JP); Yoshio Sugiura, Nishikamo-gun (JP); Naoki Tanjima, Nagoya (JP); Hirotsugu Unotoro, Nagoya (JP); Takamine Hokazono, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/483,056

(22) PCT Filed: Jul. 30, 2002

(86) PCT No.: PCT/JP02/07730

§ 371 (c)(1),
(2), (4) Date: Jan. 7, 2004

(87) PCT Pub. No.: WO03/011603

PCT Pub. Date: Feb. 13, 2003

(65) Prior Publication Data

US 2004/0184862 A1 Sep. 23, 2004

(30) Foreign Application Priority Data

Jul. 30, 2001 (JP) ..... 2001-229519

(51) Int. Cl.
*B41J 11/44* (2006.01)

(52) U.S. Cl. ..... 400/615.2; 400/61; 400/70; 400/76

(58) Field of Classification Search ..... 400/76, 400/70, 61, 615.2, 611, 613
See application file for complete search history.

(56) References Cited

U.S. PATENT DOCUMENTS

| | | | | |
|---|---|---|---|---|
| 6,106,176 | A * | 8/2000 | Yanagisawa et al. | 400/615.2 |
| 6,120,200 | A * | 9/2000 | Watanabe et al. | 400/615.2 |
| 6,129,462 | A * | 10/2000 | Furuya et al. | 400/61 |
| 6,130,699 | A * | 10/2000 | Christensen et al. | 347/218 |
| 6,287,030 | B1 * | 9/2001 | Furuya et al. | 400/615.2 |

FOREIGN PATENT DOCUMENTS

| | | | |
|---|---|---|---|
| EP | 0 741 044 | A2 | 11/1996 |
| EP | 0 943 447 | A1 | 9/1999 |
| JP | A 63-295285 | | 12/1988 |
| JP | A 64-85773 | | 3/1989 |
| JP | 03198675 | A * | 8/1991 |
| JP | A 07-285240 | | 10/1995 |
| JP | A 2000-185433 | | 4/2000 |

OTHER PUBLICATIONS

IBM Technical Disclosure Bulletin, vol. 32, Issue 2, pp. 56-58, Electronic Backlash Compensation for Serial Printers, Jul. 1989.*

* cited by examiner

*Primary Examiner*—Minh Chau
(74) *Attorney, Agent, or Firm*—Oliff & Berridge, PLC

(57) ABSTRACT

A tape printer for securing a time period sufficient for processing printing data even if the rpm of a DC motor increases, when an encoder is used for detecting rotation of the DC motor. When the DC motor does not rotate at a constant speed, in principle, the encoder detects an amount of rotation of the DC motor. Accordingly, a thermal head is driven for printing, every time a predetermined angle of rotation is sensed. On the other hand, when the DC motor rotates at a constant speed, the thermal head is driven for printing at constant intervals.

7 Claims, 14 Drawing Sheets

OUTPUT OF PHOTO-SENSOR 49b

OUTPUT OF PHOTO-SENSOR 49c (FORWARD ROTATION)

OUTPUT OF PHOTO-SENSOR 49c (REVERSE ROTATION)

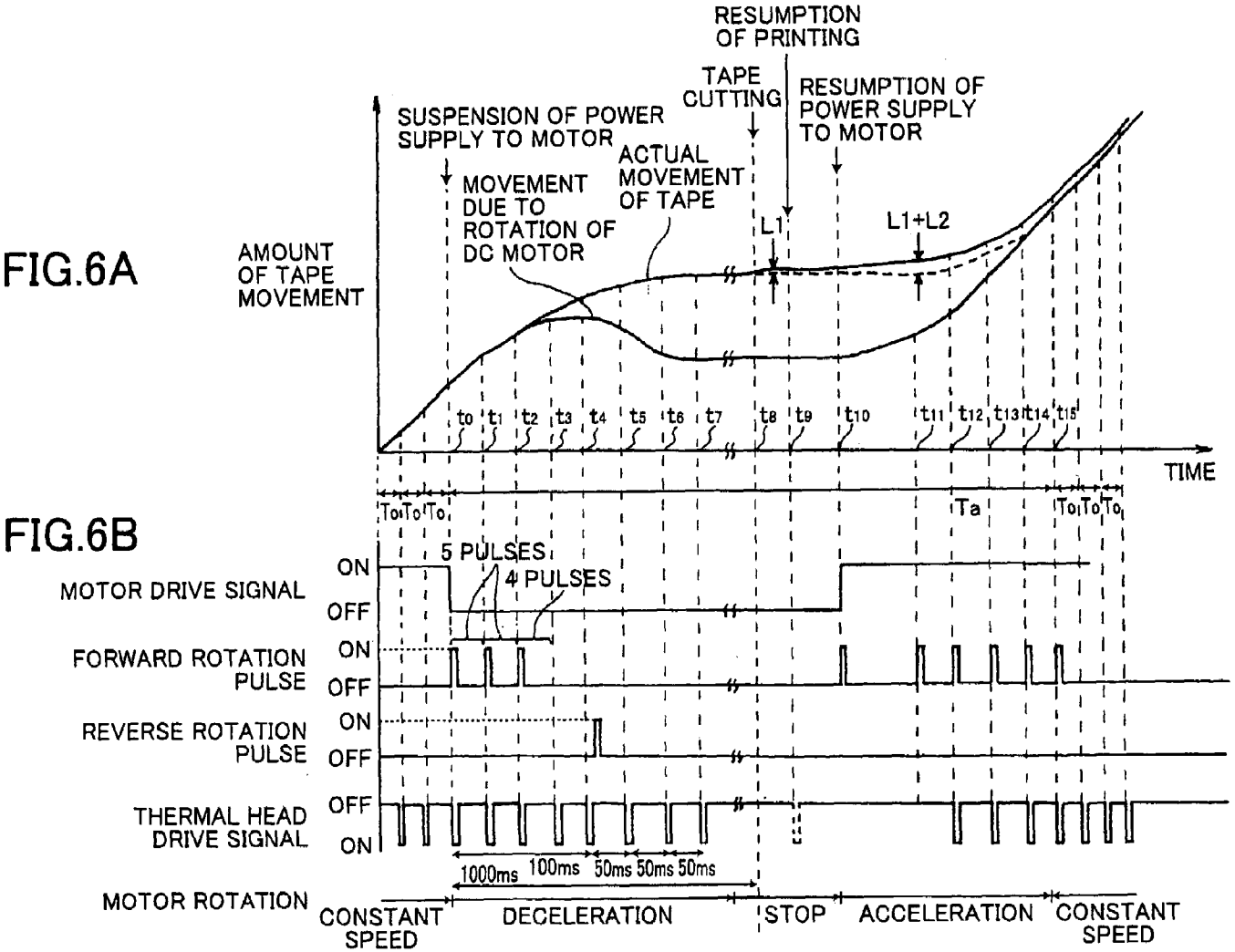
RESUMPTION OF PRINTING
TAPE CUTTING
RESUMPTION OF POWER SUPPLY TO MOTOR
SUSPENSION OF POWER SUPPLY TO MOTOR
ACTUAL MOVEMENT OF TAPE
MOVEMENT DUE TO ROTATION OF DC MOTOR
L1
L1+L2
AMOUNT OF TAPE MOVEMENT
TIME
t0 t1 t2 t3 t4 t5 t6 t7 t8 t9 t10 t11 t12 t13 t14 t15
Ta
5 PULSES
4 PULSES
MOTOR DRIVE SIGNAL
FORWARD ROTATION PULSE
REVERSE ROTATION PULSE
THERMAL HEAD DRIVE SIGNAL
MOTOR ROTATION
ON
OFF
1000ms
100ms
50ms
CONSTANT SPEED
DECELERATION
STOP
ACCELERATION
FIG.6A
FIG.6B

TAPE PRINTER

TECHNICAL FIELD

The present invention relates to a tape printer for performing line printing on a printing medium by using dot patterns.

BACKGROUND ART

Tape printers are well-known for unwinding and running wound long tape by a direct current motor (designated as DC motor hereinafter) and performing line printing on the unwound tape by using dot patterns. Some of such tape printers are provided with a cutter for cutting the tape downstream from the printing position. A printed strip having a desired length is produced because the original tape can be cut manually or automatically after printing.

The above tape printers may be provided with an encoder to detect an amount of rotation of the DC motor. The encoder has a rotary disk having radial slits formed peripherally at regular intervals. The disk is connected to an output shaft of the DC motor. The encoder has a photo-sensor having a light-emitting element and a light-receiving element disposed at the opposite sides of the rotary disk. When the encoder is used, the printing head is driven to print on the tape, every time the amount of rotation of the DC motor increases by a predetermined amount based on an output pulse signal of the light-receiving element. This arrangement allows the tape to be constantly printed at uniform dot intervals in the running direction of the tape, regardless if the tape runs at a constant speed or not.

As described above, when the timing of driving the printing head is always determined according to the output signal of the encoder, the printing cycle may become short when a change in the rotations of the DC motor is large and the DC motor rotates at a high speed. Therefore, unless high performance hardware is provided, it is difficult to secure a time period sufficient for a printing data processing which is performed while the printing head is at rest such as development of outline font data into bit map data, character ornamentation, and conversion of vertical lines into horizontal lines and vice versa. Accordingly, deterioration of the quality of printed image such as Printing error may caused.

Therefore, it is a main object of the present invention to provide a tape printer that can secure a time period sufficient for processing printing data and print a high quality image if the DC motor rotates at a high speed in the case an encoder is used.

DISCLOSURE OF THE INVENTION

To accomplish the above object, a tape printer according to the present invention has a printing head that prints a dot pattern on a printing medium on a line basis, the printing medium having a tape shape; and a feed mechanism that relatively moves one of the printing medium and the printing head against the other. The tape printer further has a direct current motor that drives the feed mechanism; forward rotation detection means that detects an amount of forward rotation of the direct current motor; and printing control means that controls a driving timing of the printing head. The printing control means prints data related on a line sequentially every time the amount of forward rotation of the direct current motor detected by the forward rotation detection means increases by a predetermined amount during at least a part of a period from a suspension of power-supply of the direct current motor to a start of constant-speed rotation of the direct current motor through a stop of the direct current motor and a resumption of the power supply of the direct current motor. The printing control means prints data related on a line at predetermined intervals during a period of a constant rotation of the direct current motor.

Thus, according to the invention, a printing is performed at predetermined intervals irrespective of an output signal from an encoder while the DC motor rotates at a constant speed. Accordingly, it is possible to secure a period sufficient for a data process that is required while the printing head is at rest (in other words, in a time period between the subsequent printings of adjacent dots). When the DC motor does not rotate at a constant speed, the printing timing is determined according to the amount of forward rotation of the DC motor based on an output signal of the encoder. Therefore, displacement of printed dots can be avoided with a high accuracy, compared with an arrangement for determining the printing timing based on the time elapsed after the suspension of the power supply to the DC motor, for instance.

The tape printer according to the present invention further includes reverse rotation detection means that detects an amount of reverse rotation of the direct current motor. The printing control means controls the driving timing of the printing head after the resumption of the power supply to the direct current motor so as to compensate the amount of reverse rotation of the direct current motor detected by the reverse rotation detection means during a period from the suspension of power supply of the direct current motor to the stop of the direct current motor.

Thus, according to the invention, it is possible to suppress the displacement of printed dots attributable to a reverse rotation of the DC motor during the time period from the suspension of the power supply to the stop of the DC motor. Accordingly, adjacent dots are joined properly to each other, so that the quality of the printed image is improved.

The tape printer of the present invention further has fluctuation reduction means that reduces a fluctuation in the rotation of the direct current motor.

Thus, according to the invention, a fluctuation in the revolutions of the DC motor is minimized, so that the DC motor rotates at a substantially constant speed. Therefore, when the printing is performed at predetermined intervals, the distance between the printed dots is maintained constant, so that the printing quality is improved.

A tape printer according to the present invention has a printing head that prints a line including a dot pattern arranged in a width direction of a printing medium having a tape shape; a feed mechanism that moves either one of the printing medium and the printing head against the other, the feed mechanism including a direct current motor; and printing control means that controls driving of the printing head and the motor. The tape printer further has forward rotation detection means that detects an amount of forward rotation of the direct current motor. The control means prints a line sequentially every time the amount of forward rotation of the direct current motor detected by the forward rotation detection means increases by a predetermined amount during a period from suspension of power supply to the direct current motor to a start of constant-speed rotation of the direct current motor through a stop of rotation of the direct current motor and a resumption of power supply to the direct current motor. Additionally, the printing control means prints the line at predetermined time intervals during a period of constant-speed rotation of the direct current motor.

Thus, according to the invention, when the DC motor rotates at a constant speed, it is possible to secure a period sufficient for the printing control means to process printing data. When the DC motor does not rotate at a constant speed, a printing is performed every time the DC motor rotates forward by a predetermined angle, so that it is possible to prevent displacement of printed dots.

BRIEF DESCRIPTION OF THE DRAWINGS

FIG. 4A shows the output of the photo-sensor 49*b*, FIG. 4B shows the output of the photo-sensor 49*c* when the rotary disk of the encoder rotates forward, and FIG. 4C shows the output of the photo-sensor 49*c* when the rotary disk of the encoder rotates backward;

FIG. 6A is a graph illustrating the change of the amount of movement of the tape and the amount of rotary movement of the DC motor against time (which is converted to the amount of movement of the tape) before and after tape cutting in the course of printing;

FIG. 6B is a graph illustrating the change in the DC motor drive signal, the forward rotation pulse, the reverse rotation pulse, the thermal head drive signal, and the rotary movement of the DC motor against time, which is associated with the amount of movement of the tape as shown in FIG. 6A;

BEST MODE FOR CARRYING OUT THE INVENTION

Now, a preferred embodiment of the present invention will be described by referring to the accompanying drawings.

Figure 1:
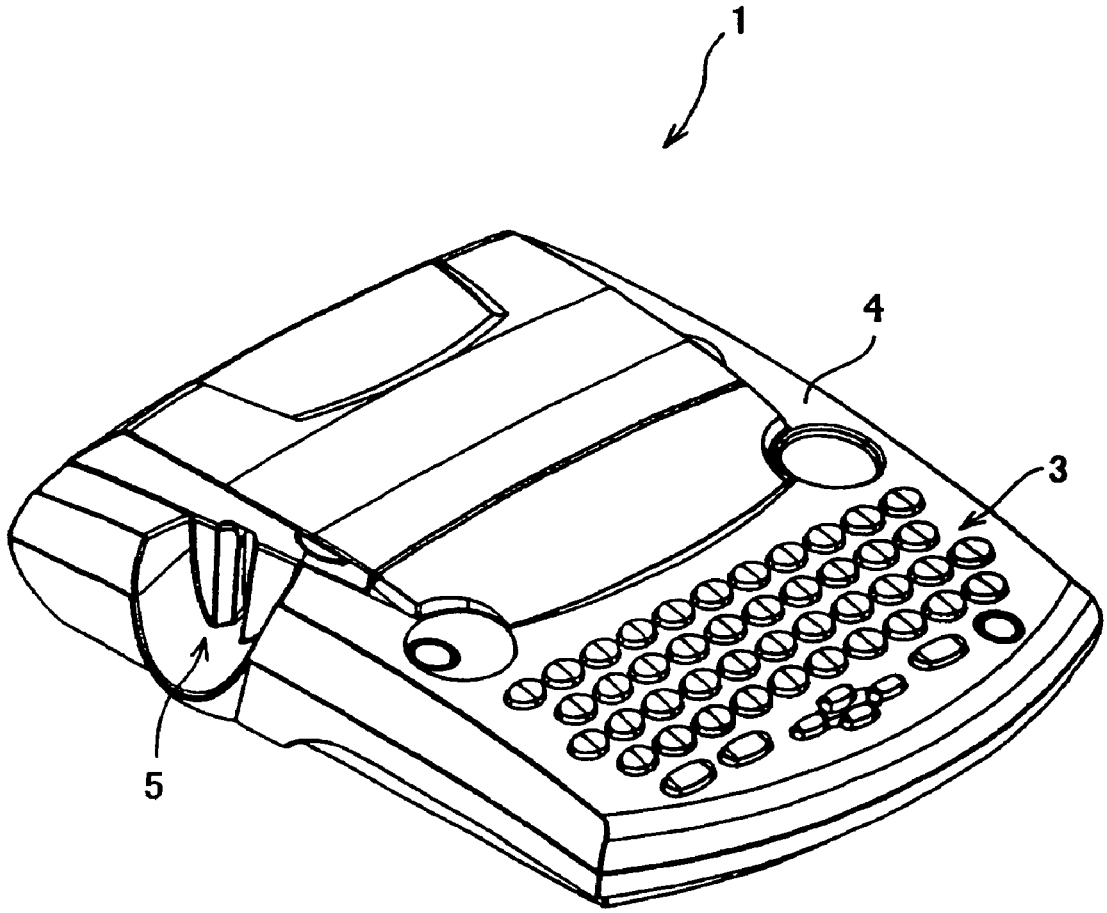
FIG. 1 is a perspective view of a tape printer of an embodiment of the present invention.
Figure 2:
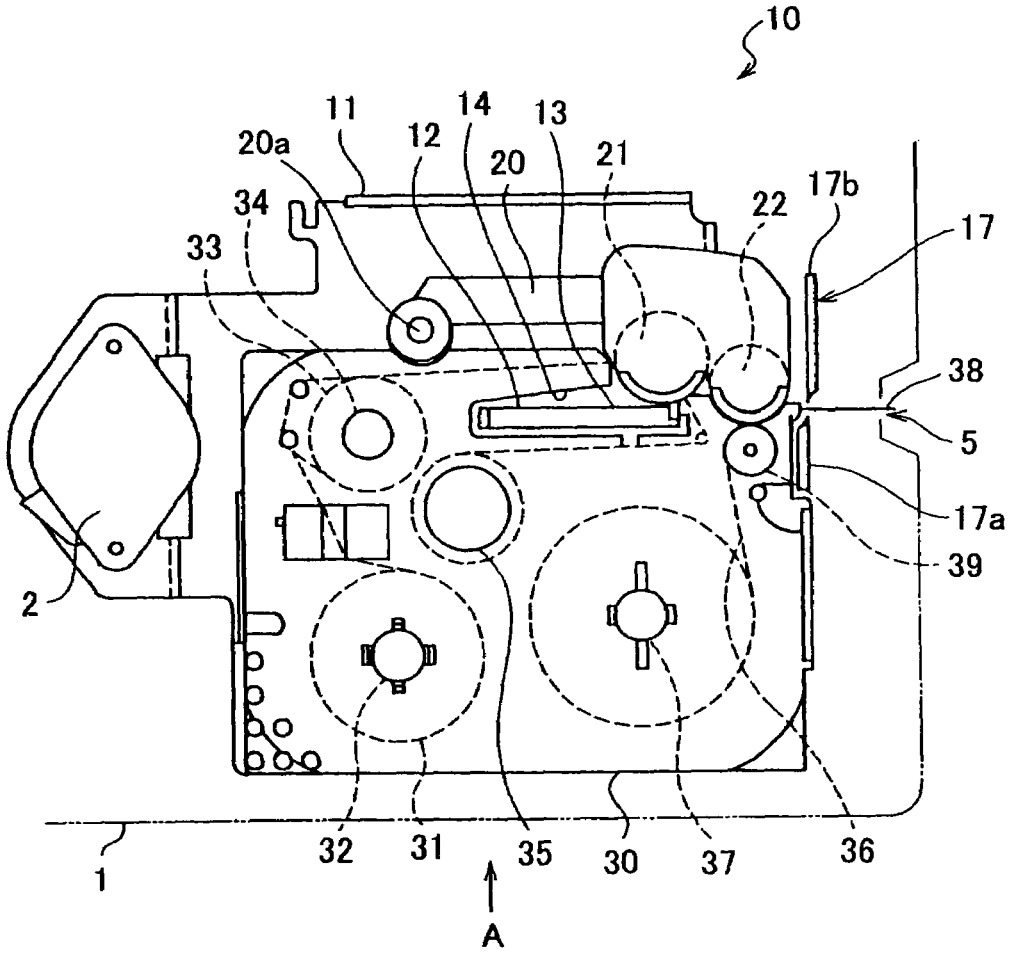
FIG. 2 is a plan view of the tape driving/printing mechanism and a tape-containing cassette arranged in the tape printer of FIG. 1.

FIG. 1 shows a tape printer 1 of an embodiment of according to the present invention. As shown in FIG. 1, the tape printer 1 has a keyboard 3 having a lot of keys on a top surface of a main body 4 such as character keys and control keys. As shown in FIG. 2, the tape printer 1 further includes a cassette-containing frame 11. The cassette-containing frame 11 is configured to removably receive a tape-containing cassette 30. The cassette-containing frame 11 is provided with a tape driving/printing mechanism 10 and a cutter 17 for cutting a tape. A tape eject port 5 is formed on a lateral side of the main body 4. A printed strip is drawn from the tape-containing cassette 30, cut by means of the cutter 17, and then ejected to the outside of the main body 4 through the tape eject port 5. Additionally, a control circuit (not shown) is provided in the main body 4 in order to control printing of the tape printer 1 in response to an input through the keyboard 3.

As shown in FIG. 2, the tape-containing cassette 30 contains a tape spool 32, a ribbon supply spool 34, a take-up spool 35, a base member supply spool 37, and a bonding roller 39 which are rotatably arranged at respective predetermined positions in the tape-containing cassette 30. The tape spool 32 has a transparent surface layer tape 31 of polyethylene terephthalate (PET) wound. The ribbon supply spool 34 has an ink ribbon 33 wound. The take-up spool 35 takes up the used part of the ink ribbon 33. A two-layered tape 36 includes a two-sided adhesive tape having two adhesive layers on both sides thereof and the same width as that of the surface layer tape 31. The two-layered tape 36 has a peeling tape on one side. The base member supply spool 37 has the two-layered tape 36 wound with the peeling tape facing outside. The bonding roller 39 joins the two-layered tape 36 and the surface layer tape 31 together.

Figure 3:
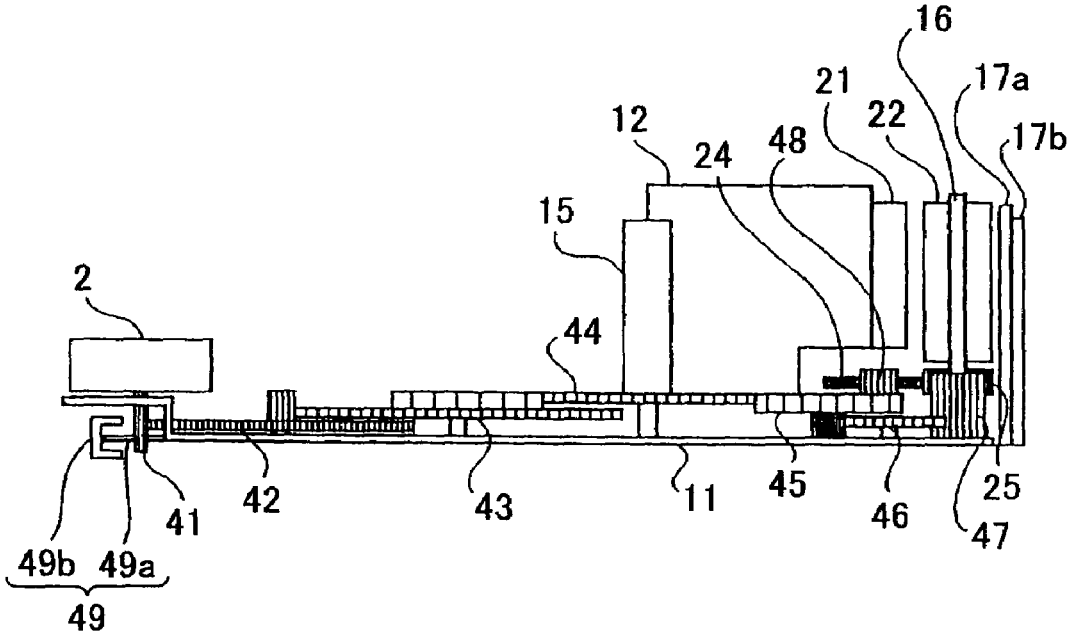
FIG. 3 is a lateral view of the tape driving/printing mechanism of FIG. 2 without the tape-containing cassette as viewed from the direction of arrow A.

As shown in FIG. 2, the cassette-containing frame 11 is provided with an arm 20 that angularly rotates around axis 20*a*. As shown in FIGS. 2 and 3, a platen roller 21 and a feed roller 22 are rotatably mounted to the front end of the arm 20. Both the platen roller 21 and the feed roller 22 have a flexible surface member of rubber. When the arm 20 is angularly moved clockwise to its extreme position, the platen roller 21 presses a thermal head 13 which is arranged on a plate 12 through the surface layer tape 31 and the ink ribbon 33. Simultaneously, the feed roller 22 presses the bonding roller 39 through the surface layer tape 31 and the two-layered tape 36.

The plate 12 is standing from the cassette-containing frame 11. The thermal head 13 is arranged on the plate 12 facing the platen roller 21. A lot of heat-emitting elements are arranged in a row perpendicular to a running direction of the tape. The plate 12 is adapted to be fitted into a recess 14 of the tape-containing cassette 30 when the tape-containing cassette 30 is mounted onto a predetermined position in the cassette-containing frame 11. As shown in FIG. 3, a ribbon take-up roller 15 and a bonding roller drive roller 16 are standing from the cassette-containing frame 11. When the tape-containing cassette 30 is mounted onto a predetermined position in the cassette-containing frame 11, the ribbon take-up roller 15 and the bonding roller drive roller 16 are introduced into the take-up spool 35 and the bonding roller 39, respectively.

A DC motor 2 for running the tape is fitted to the cassette-containing frame 11. The rotary drive force generated from an output shaft 41 of the DC motor 2 is transmitted to the ribbon take-up roller 15, the bonding roller drive roller 16, the platen roller 21, and the feed roller 22 through disk gears 42, 43, 44, 45, 46, 47, 48 and disk-shaped gears 24, 25. The disk gears 42, 43, 44, 45, 46, 47, and 48 are arranged in mesh with each other along the cassette-containing frame 11. The disk-shaped gears 24, 25 are arranged in series with the platen roller 21 and the feed roller 22, respectively.

Accordingly, power supplied to the DC motor 2 rotates the output shaft 41, the take-up spool 35, the bonding roller 39, the platen roller 21, and the feed roller 22. Thus, the surface layer tape 31, the ink ribbon 33, and the two-layered tape 36 housed in the tape-containing cassette 30 are unwound and transferred downstream by the drive force generated by rotation. The surface layer tape 31 and the ink ribbon 33 are overlapped together, and then forced to pass between the platen roller 21 and the thermal head 13. The surface layer tape 31 and the ink ribbon 33 are pinched between the platen roller 21 and the thermal head 13, and transferred downstream. The surface layer tape 31 and the ink ribbon 33 are selectively and intermittently energized by a lot of heat-emitting elements arranged on the thermal head 13, so that ink on the ink ribbon 33 is transferred onto the surface layer tape 31 on a dot basis to form a desired dot image that is a mirror image of the original. After passing the thermal head 13, the ink ribbon 33 is wound around the ribbon take-up roller 15. Subsequently, the surface layer tape 31 is laid on the two-layered tape 36 to pass between the feed roller 22 and the bonding roller 39. As a result, the printed surface layer tape 31 is firmly laid on the two-layered tape 36 at the printed side thereof.

A multilayer tape 38 made of the surface layer tape 31 and the two-layered tape 36 stacked together has a printed proper image when viewed from the side opposite to the printed side of the surface layer tape 31. The printed part of the multilayer tape 38 is cut by the cutter 17 arranged downstream from the feed roller 22, and then ejected from the tape eject port 5. The cutter 17 is made of scissors having a fixed edge 17*a* and a rotary edge 17*b*. The tape is cut when the rotary edge 17*b* pivotably moves with respect to the fixed edge 17*a*. The rotary edge 17*b* is pivotably moved around a fulcrum by a cutter drive motor 72 (not shown) to cut the multilayer tape 38. The strip produced by cutting the multilayer tape 38 can be used as a sticky label that is applied to a desired object when the peeling tape is peeled off.

As shown in FIG. 3, the DC motor 2 is provided with an encoder 49 as a sensor for detecting an amount of rotary movement of the DC motor 2. The encoder 49 has a rotary disk 49*a* and two pairs of photo-sensors 49*b*, 49*c*. The rotary disk 49*a* has radial slits formed peripherally at regular intervals and joined to an output shaft 41 of the DC motor 2 that operates as rotary shaft for the encoder 49. The two pairs of photo-sensors 49*b*, 49*c*, each of which has a light-emitting element and a light-receiving element, are disposed at the opposite sides of the rotary disk 49*a* (only the photo-sensor 49*b* is shown in FIG. 3. The photo-sensor 49*c* is arranged behind the photo-sensor 49*b*). The light beams emitted from the light-emitting elements of the two photo-sensors 49*b*, 49*c* are blocked by the slits, or pass through one of the slits to reach the corresponding light-receiving elements, depending on the rotary position of the rotary disk 49*a*.

Figures 4A, 4B, 4C:
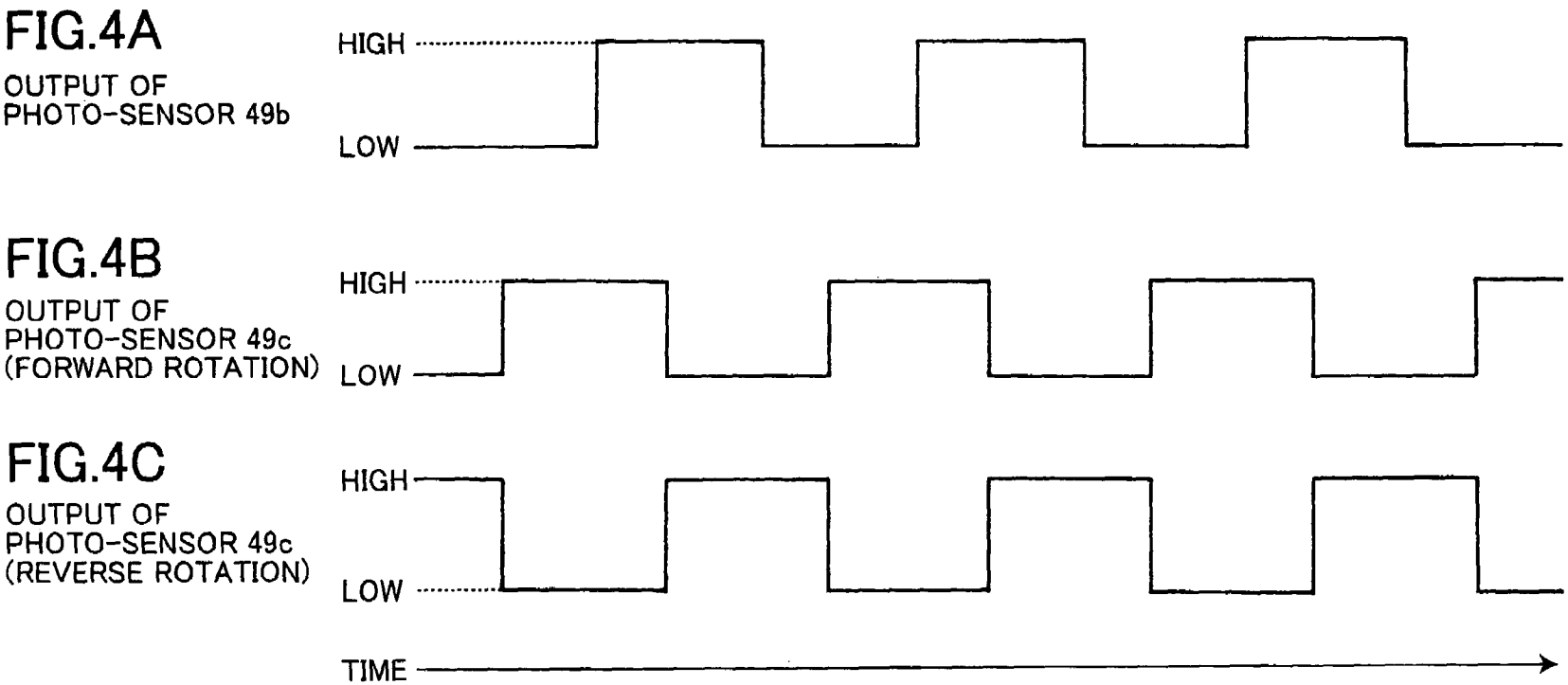
FIGS. 4A through 4C are timing charts of output signals of the encoder arranged in the tape printer of FIG. 1.

The gap separating the two photo-sensors 49*b*, 49*c* and the intervals of the slits are designed in such a way that the phase of the output signal of one of the photo-sensors is shifted by 180° from the phase of the output signal of the other photo-sensor when the rotary disk 49*a* rotates forward or backward. This will be described in detail by referring to FIGS. 4A through 4C. FIG. 4A illustrates the output signal of the photo-sensor 49*b* when the rotary disk 49*a* rotates. FIG. 4B shows the output signal of the photo-sensor 49*c* when the rotary disk 49*a* rotates forward. FIG. 4C illustrates the output signal of the photo-sensor 49*c* when the rotary disk 49*a* rotates reverse.

As seen from the output signals of the photo-sensors 49*b*, 49*c*, when the rotary disk 49*a* rotates forward, the output signal of the photo-sensor 49*c* is already at a low level, while the output signal of the photo-sensor 49*b* rises from a low level to the high level. On the other hand, when the rotary disk 49*a* rotates backward, the output signal of the photo-sensor 49*c* is at the low level when the output signal of the photo-sensor 49*b* rises from the low level to the high level. Therefore, it is possible to determine if the rotary disk 49*a* rotates forward or backward by comparing the output signals of the light-receiving elements of the two photo-sensors 49*b*, 49*c*. Alternatively, instead of the two photo-sensors 49*b*, 49*c* shown in FIG. 3, a single two-phased photo-sensor can be used.

Figure 5:
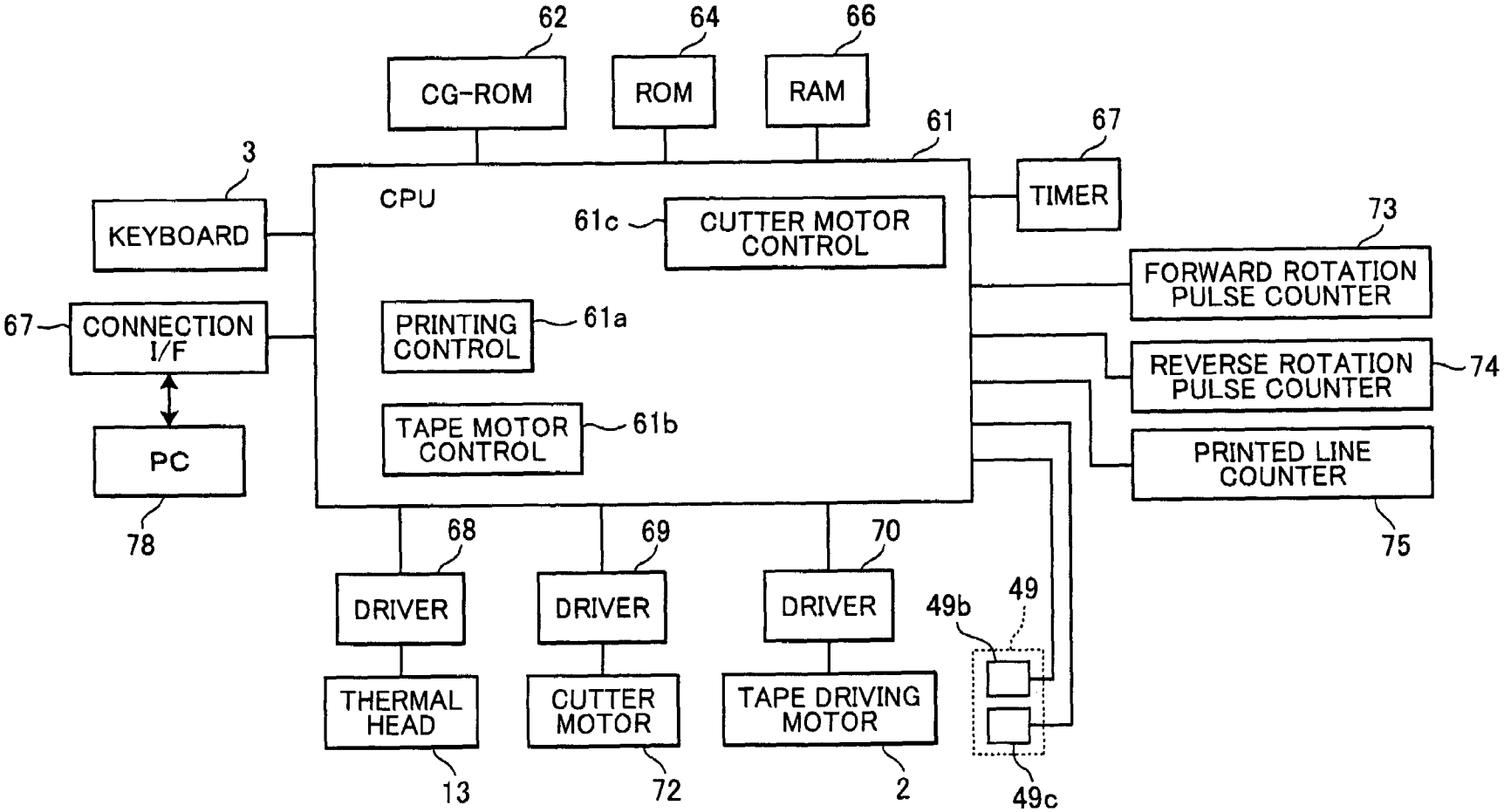
FIG. 5 is a block diagram of the tape printer of FIG. 1.

As shown in FIG. 5, the tape printer 1 of the present invention has a CPU 61, a CG-ROM 62, a ROM 64, a RAM 66, a timer 67, a driver circuit 68 for the thermal head 13, a driver circuit 69 for the cutter drive motor 72, and a driver circuit 70 for the DC motor. The CPU 61 is connected to the CG-ROM 62, the ROM 64, the RAM 66, the timer 67, and the driver circuits 68 through 70. The CPU 61 is also connected to the encoder 49, the keyboard 3, and the connection interface 67. The CPU 61 then performs several kinds of arithmetic operations and manages input/output of the signal. The connection interface 67 is connected to an external device 78 such as a personal computer wirelessly or with a wire.

The CG-ROM 62 is a character generator memory to store image data for characters and signs to be printed in the form of dot patterns with the corresponding code data. The ROM 64 stores several kinds of programs and data-tables to operate the tape printer 1. The RAM 66 temporarily stores the data entered from the keyboard 3 and/or the external device 78 through the connection interface 67, and the result of arithmetic operations by the CPU 61. The timer 67 notifies the CPU 61 of the elapsed time from a reference time in response to a clock signal.

The CPU 61 includes a printing control section 61*a* for controlling the printing by the thermal head 13, a tape motor control section 61*b* for controlling the DC motor 2, and a cutter motor control section 61*c* for controlling the cutter drive motor 72.

The driver circuit 68 supplies a drive signal to the thermal head 13 in synchronism with the driving of the DC motor 2 in response to the control signal from the printing control section 61*a*. Additionally, the printing control section 61*a* develops the printing data to be printed on the tape into a bit map, referring to the data in the CG-ROM 62. The printing control section 61*a* then divides the developed bit map into printing lines, each of which consists of a dot pattern that is printed by a single operation of the thermal head 13 in a direction perpendicular to the running direction of the tape. The printing control section 61*a* sends the data of each printing line sequentially to the driver circuit 68 according to the order in which the line is printed.

The driver circuit 69 supplies a drive signal to a cutter drive motor 72 in response to the control signal from the cutter motor control section 61*c*. The driver circuit 70 supplies a drive signal to the DC motor 2 in response to a control signal from the tape motor control section 61*b*.

The CPU 61 generates a forward rotation pulse indicating that the DC motor 2 rotates forward and a reverse rotation pulse indicating that the DC motor 2 rotates backward on the basis of the outputs of the photo-sensors 49*b*, 49*c* in the encoder 49, every time the DC motor 2 rotates by a predetermined angle. The CPU 61 is connected to a forward rotation pulse counter 73 and a reverse rotation pulse counter 74. The counters 73 and 74 count the number of forward and reverse rotation pulses generated by the rotations of the DC motor, respectively. The CPU 61 is also connected to a printed line counter 75 for counting the number of printed lines. The count of the printed line counter 75 corresponds to the number of the printed lines by the thermal head 13 on the tape that is moved by the DC motor.

The driver circuit 70 for the DC motor 2 includes an electronic governor circuit and a voltage supply circuit (not shown). The electronic governor circuit includes a proportional current control IC (constant speed control IC) for the DC motor 2 so as to perform a proportional current control of maintaining a back electromotive force of the DC motor 2 to a constant level. When a certain period of time has elapsed after the start of power supply regardless of the level of the supply voltage, the DC motor 2 rotates at a constant number of rotations due to the operation of the electronic governor circuit. This arrangement minimizes changes in the rotation of the DC motor 2. On the other hand, the voltage supply circuit includes a power source terminal connected to the power source for providing a supply voltage, and a transistor that is a switching element for turning on and off the supply of power from the power source to the DC motor 2. The switching of the transistor results in the switching of the supply of power to the DC motor 2.

A specific control sequence of the tape printer 1 of this embodiment will be described by referring to FIGS. 6 through 14.

It should be noted that FIGS. 6A and 6B shows one example of the forward rotation pulses, the reverse rotation pulses, and the thermal head drive signals.

In order to print a desired image on the tape by means of the tape printer 1 of this embodiment, characters and signs to be printed may be entered by operating the keyboard 3, or graphics to be printed may be entered from the external device 78 connected to the tape printer 1. The entered data are then stored in a predetermined area in the RAM 66 as printing data. An appropriate editing may be performed, if necessary.

Figure 7:
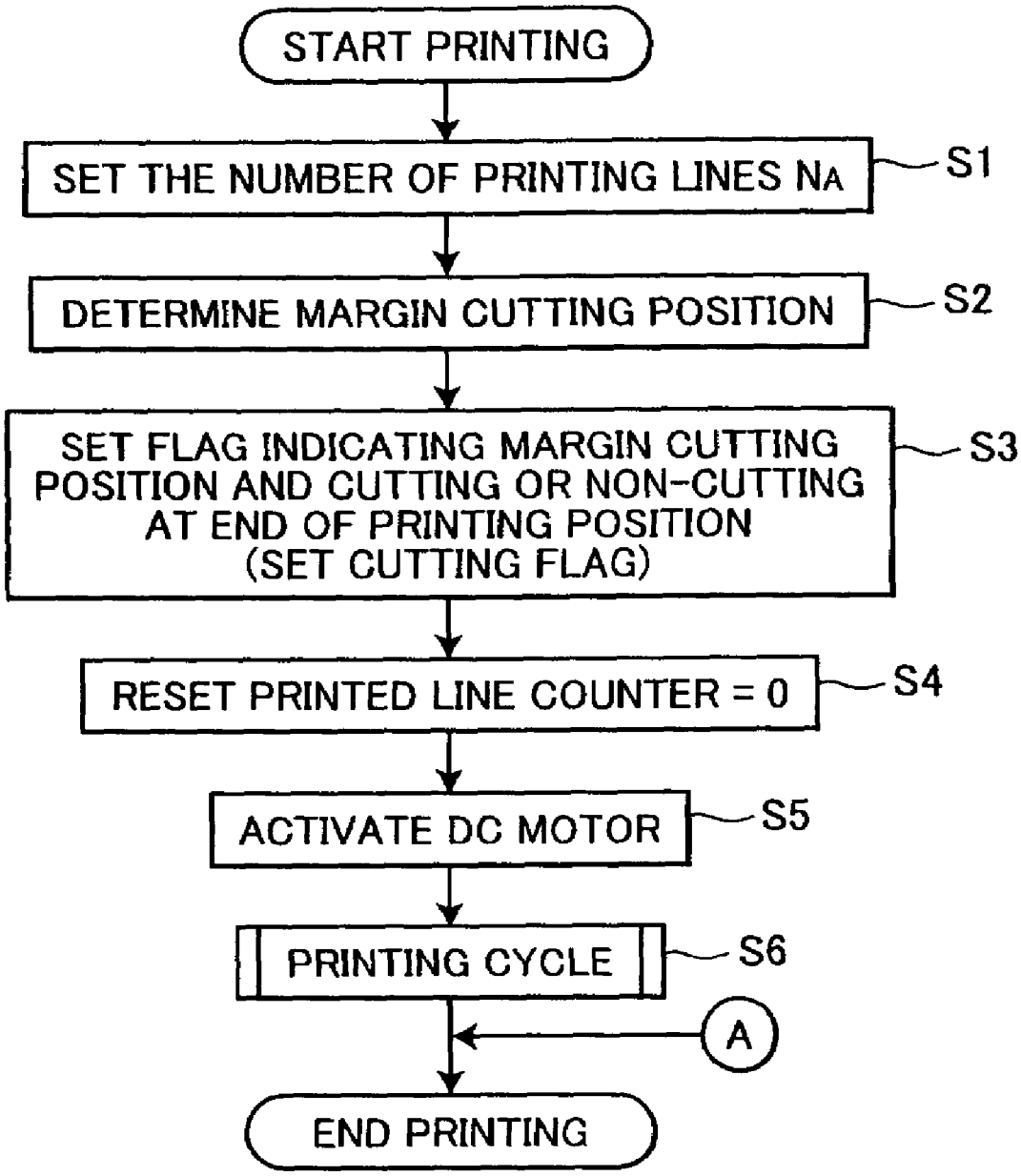
FIG. 7 is a flow chart for controlling the printing of the tape printer of FIG. 1.
Figure 8:
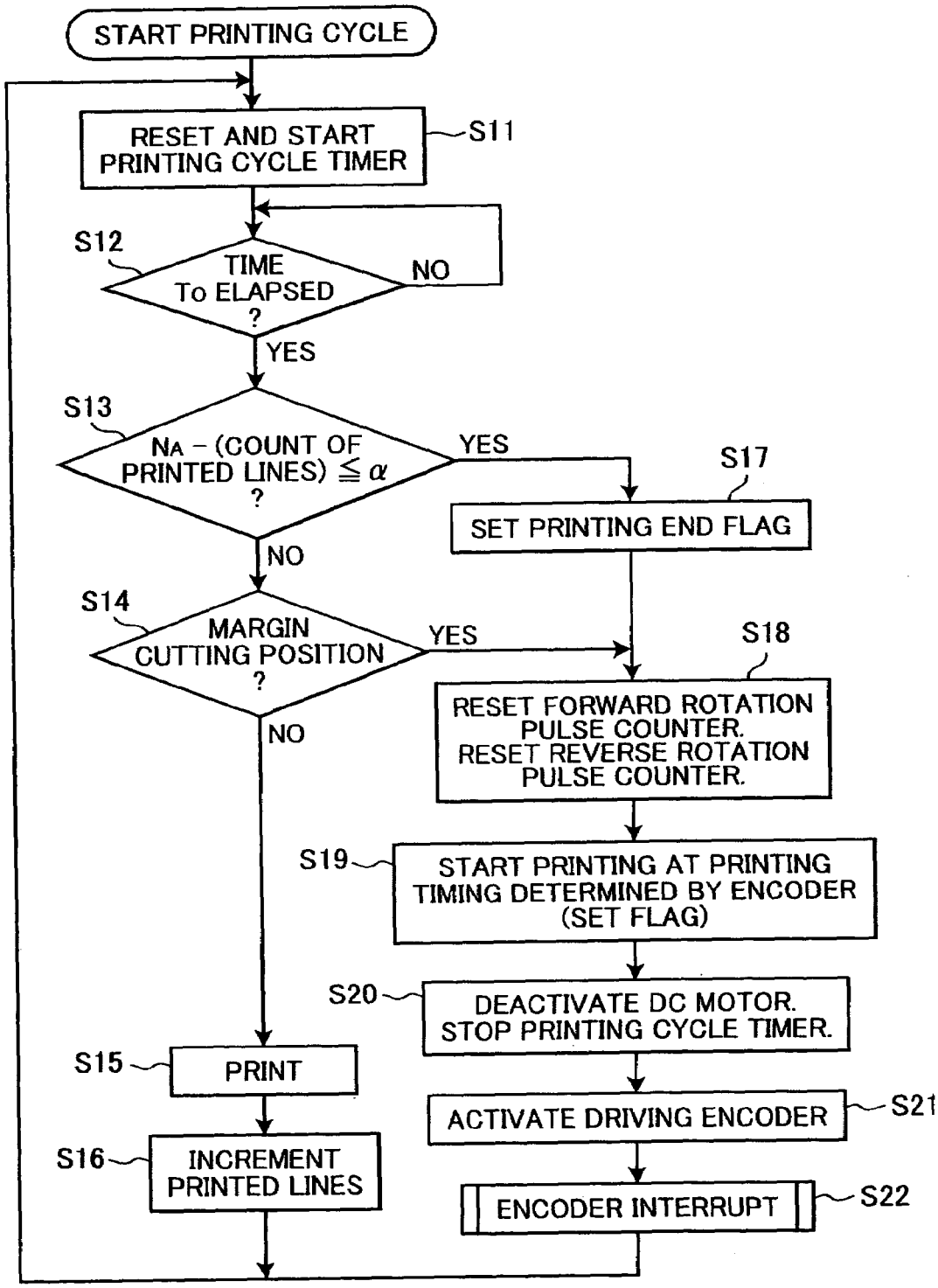
FIG. 8 is a flow chart illustrating the printing cycle.

A printing starts when the print key of the keyboard 3 is pressed or a printing instruction is issued from the external device 78. FIG. 7 illustrates the printing control procedure. As shown in FIG. 7, the printing control section 61*a* develops the printing data stored in the RAM 66 into dots of a bit map, for example, referring to the code data stored in the CG-ROM 62 to divide the dots of bit map into printing lines, thereby calculating the total number of printing lines NA in Step S1. Additionally, each of the printing lines is associated with the order in which the line is actually printed. The number of printing lines NA is entered in a predetermined area of the RAM 66. Then, in Step S2, the printing control section 61*a* determines the position for the margin of the tape to be cut, considering the distance between the thermal head 13 and the cutter 17, and the moving distance of the tape from the suspension of power supply of the DC motor 2 to the actual stop of DC motor 2. The printing control section 61*a* sets the position for the margin of the tape to be cut in the RAM 66. It should be noted that the position of the margin to be cut is stored not only in the case the tape is actually cut but also in the case the DC motor is temporarily stopped without cutting the tape because of the excess amount of print data over the memory capacity. When a lot of images is printed, the number of printing lines NA is set for each image. Subsequently, in Step S3, a cut flag indicating whether the tape is cut at the position at which the printing of the printing lines NA set in Step S1 is over, or at a position of the margin to be cut of Step S2 is set in a predetermined area of the RAM 66.

Then, in Step S4, the count N of the printed line counter 75 is initialized to "0." The operation then proceeds to Step S5. In Step S5, power supply to the DC motor 2 starts under the control of the tape motor control section 61*b* so that the tape starts running. Thereafter, a printing cycle starts in Step S6.

The printing cycle is an operation of the printer which drives the thermal head 13 to print on the tape running at a constant speed on a line basis at a predetermined interval T0. The printing cycle will be described in detail by referring to FIG. 8.

In Step S11, the timer 67 is reset and starts measuring time as printing cycle timer 67. Then, in Step S12, it is determined if the printing cycle timer 67 shows T0 or not. If the printing cycle timer indicates T0, the operation proceeds to Step S13. In step S13, it is determined if the current position is within the printing end zone that corresponds to the number of printing lines NA. In other words, it is determined if the difference between the count N of the printed line counter and the number of printing lines NA is within a predetermined range $\alpha$ ($\alpha$ is an arbitrary natural number). If the difference between N and NA is not within the predetermined range $\alpha$ in Step S13 (S13: NO), the operation proceeds to Step S14. Then, in Step S14, it is determined if the current N of the printed line counter corresponds to the position of the margin of the tape to be cut as determined in Step S2. If it is determined that the current count N does not correspond to the position of the margin of the tape to be cut (S14: NO), the operation proceeds to Step S15.

In Step S15, the data for line printing corresponding to the count N of the printed line counter 75 among printing data stored in the RAM 66 is supplied to the driver circuit 68 by the printing control section 61*a*. Accordingly, the thermal head 13 performs dot-printing on the surface layer tape 31. It should be noted that the printing cycle time T0 is determined so as to provide sufficient time for the data process such as the above development into a bit map.

Subsequently, in Step S16, the count N of the printed line counter 75 is incremented by 1. Thereafter, until the count N of the printed line counter 75 reaches within the printing end zone or in the position of the margin to be cut, the DC motor 2 is assumed to rotate at a constant speed and the tape runs at a constant speed. Therefore, the line printing on the surface layer tape 31 is repeated at a time interval T0 till the time t0. By repeating a series of the operation of Step S11 through S16, a dot pattern printing is performed on the surface layer tape 31 at the uniform dot intervals along the running direction of the tape.

In step S13, if it is determined that the current position is within the printing end zone (S13: YES), the operation proceeds to Step S17. The printing end flag is set in Step S17, and the operation proceeds to Step S18. If the current position is in the position of the margin to be cut in Step S14 (S14: YES), the operation also proceeds to Step S18. In Step S18, both the count Rf and the count Rr of the forward rotation pulse counter 73 and the reverse rotation pulse counter 74 are reset to "0".

In the next step S19, the flag for starting an encoder interrupt process for the printing at the timing determined by the encoder 49 is set in a predetermined area of the RAM 66. Subsequently, in Step S20, the supply of power to the DC motor 2 is suspended and the printing cycle timer 67 is stopped under the control of the tape motor control section 61*b*. The power supply to the DC motor 2 is suspended at time t0 in FIG. 6A. After time t0, the number of revolutions of the DC motor 2 decreases, while the running speed of the tape decreases correspondingly. Thus, in Step S21, the encoder 49 is activated, so that an encoder interrupt process is performed in Step S22. As a result, the thermal head 13 performs the printing according to the forward rotation pulse or the reverse rotation pulse generated by the encoder 49. In other words, during the encoder interrupt process, the DC motor 2 does not rotate at a constant speed and hence the tape cannot run at a constant speed. Therefore, the printing is controlled in such a way that lines are printed at the substantially fixed dot intervals along the running direction of the tape by using the output signal of the encoder 49.

Figure 9:
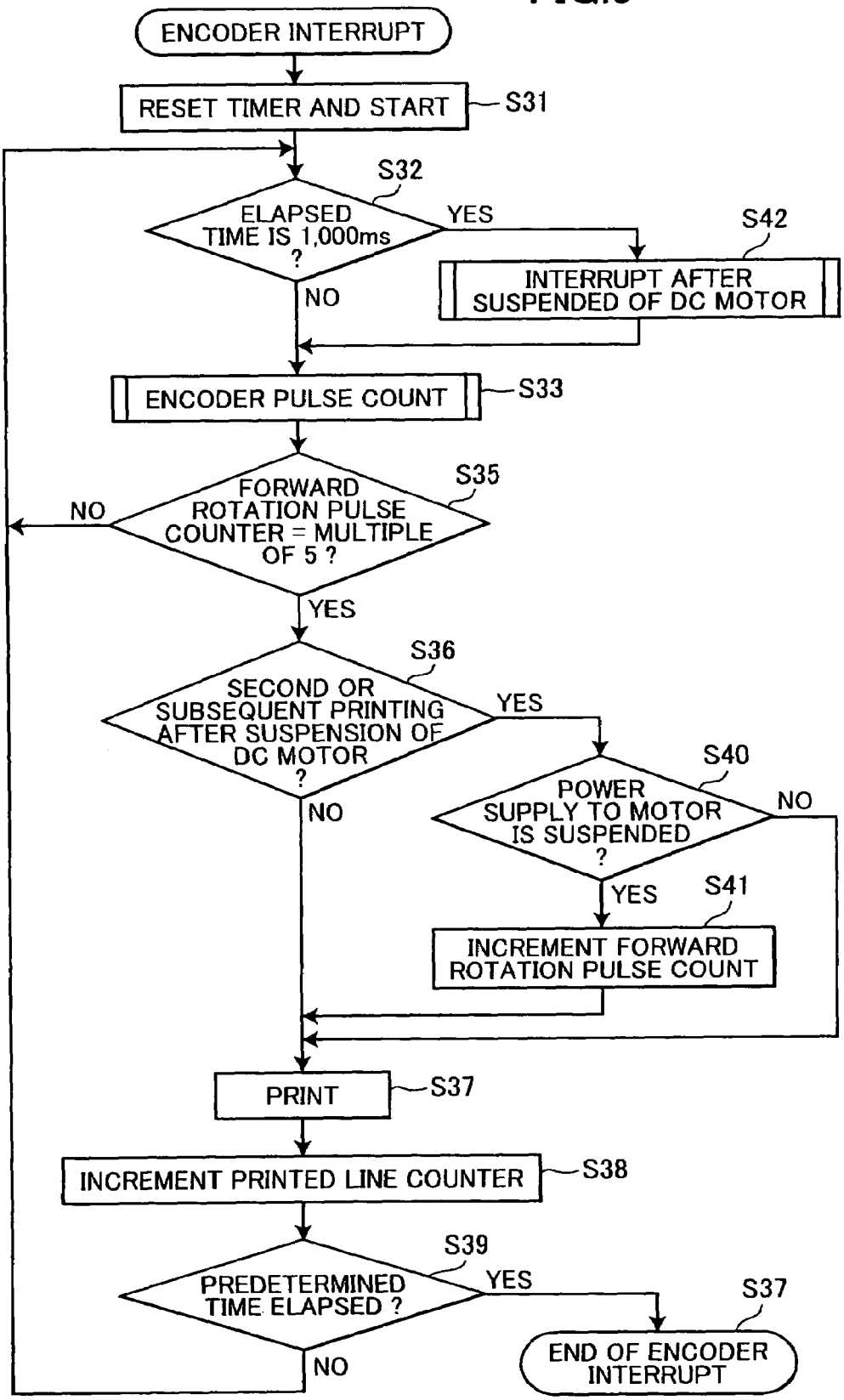
FIG. 9 is a flow chart illustrating an encoder interrupt.
Figure 10:
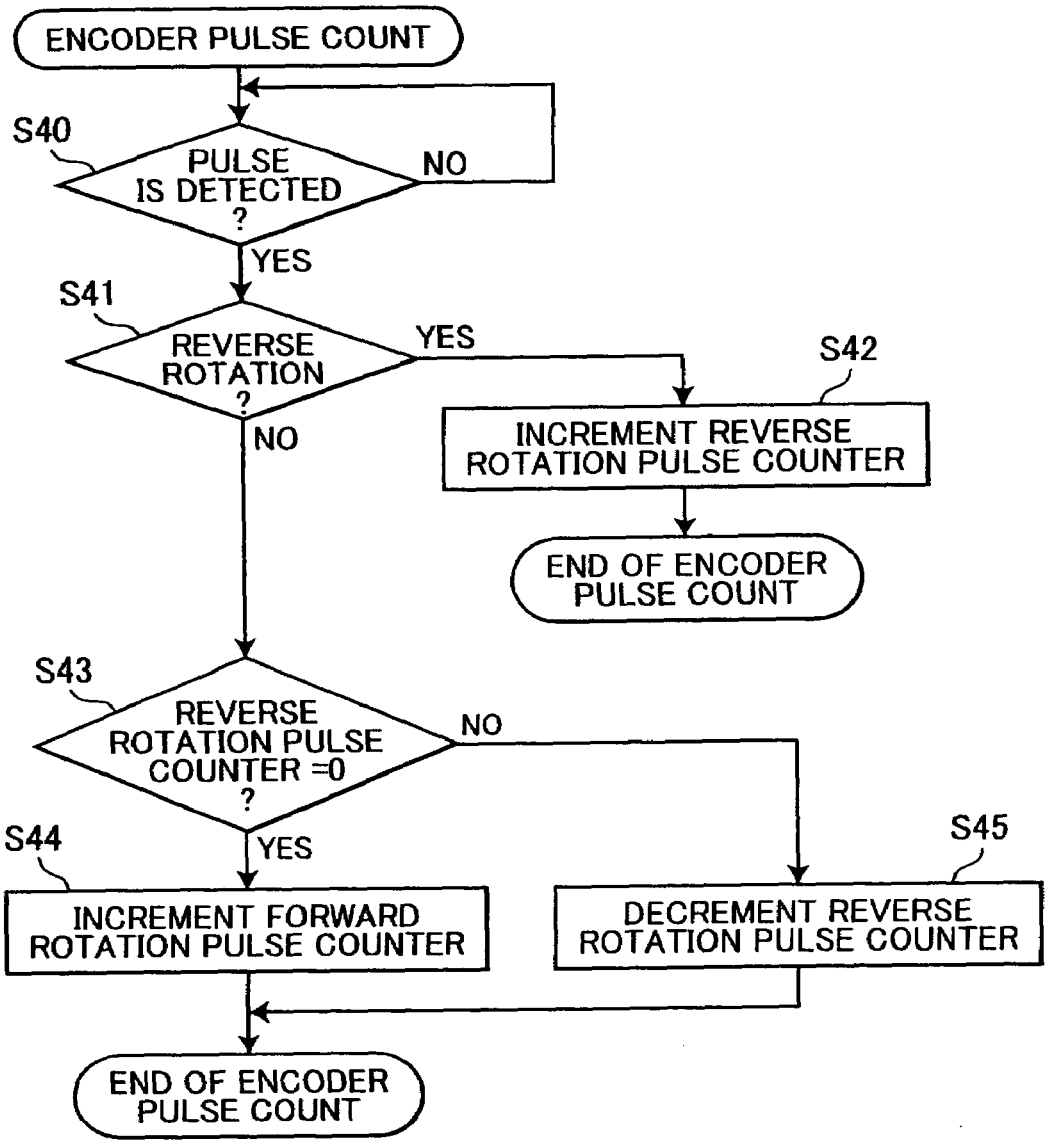
FIG. 10 is a flow chart illustrating the encoder pulse count.

FIG. 9 illustrates an encoder interrupt process. First, the timer 67 is reset after the suspension of the DC motor 2 so that measuring the elapsed time is started. In Step S32, it is determined if the timer shows 100 ms or not. If the timer does not show 100 ms (S32: NO), the operation proceeds to Step S33, where an encoder pulse count process is performed. FIG. 10 shows the details of the encoder pulse count process.

In the encoder pulse count process, the CPU 61 determines if an encoder pulse is detected from the encoder 49 in Step S40. If an encoder pulse is detected (S40: YES), the CPU 61 determines in Step S41 if the detected encoder pulse is a forward rotation pulse or a reverse rotation pulse. If the detected pulse is a reverse rotation pulse (S41: YES), the operation proceeds to Step S42, where the count of the reverse rotation pulse counter 74 is incremented and the encoder pulse count process then ends. In FIGS. 6A and 6B, a reverse rotation pulse is detected between time t4 and time t5. It is possible to measure the amount of reverse rotation of the DC motor 2 between the time the power supply to the DC motor 2 is suspended and the time the rotation of the DC motor 2 actually stops by counting the number of detected reverse rotation pulses.

On the other hand, if the detected encoder pulse is a forward rotation pulse (S41: NO), the operation proceeds to Step S43, where it is determined if the count of the reverse rotation pulse counter 74 is 0 or not. If the count value of the reverse rotation pulse counter 74 is 0 (S43: YES), the count of the forward rotation pulse counter 73 is incremented by 1 in Step S44 and the encoder pulse count processing is terminated. If the count of the reverse rotation pulse counter 74 is not 0 (S43: NO), the count of the reverse rotation pulse counter 74 is decremented by 1 in Step S45 and the encoder pulse count processing is terminated.

Thus, the encoder pulse count process obtains the amount of forward or reverse rotation of the DC motor 2 during the period from the suspension of the power supply of the DC motor 2 to the actual stop of the DC motor 2. The encoder pulse count process further obtains the amount of forward or reverse rotation of the DC motor 2 during the period from resumption of the power supply of the DC motor 2 to the constant speed running of the tape. It is also possible to compensate the amount of reverse rotation of the DC motor 2 occurring before the actual stop of the DC motor 2 with the forward rotation of the DC motor 2 after the resumption of the power supply of the DC motor 2.

Referring again to FIG. 9, in the encoder interrupt process, after the encoder pulse count process of step S33 is over, it is determined in Step S35 if the count of the forward rotation pulse counter 73 is a multiple of five or not. If the count is not a multiple of five (S35: NO), the operation returns to Step S32. If the count is a multiple of five (S35: YES), the operation proceeds to Step S36. "Five pulses" in this embodiment means the amount of forward rotation of the DC motor 2 that equal the amount of movement of the tape during time period T0 when the DC motor 2 rotates at the constant speed.

In Step S36, it is determined if the printing in the encoder interrupt process relates to the second or a subsequent printing after the suspension of the power supply to the DC motor 2. If it is determined that the printing relates to the first printing process after the suspension of the power supply to the DC motor 2 (S36: NO), the operation proceeds to Step S37, where dots printing of the printing line corresponding to the count of the printed line counter is performed on the surface layer tape 31 by the thermal head 13. It should be noted that the first printing process after the suspension of the power supply to the DC motor 2 is the time when the count of the forward rotation pulse counter 73 reaches "5" for the first time after the suspension of the power supply to the DC motor 2 as shown in FIG. 6A: time t1. Subsequently, in Step S38, the count of the printed line counter is incremented by 1.

Then, in Step S39, it is determined that a predetermined time has elapsed since the suspension of the power supply to the DC motor 2. The predetermined time in the present invention refers to time period Ta from the suspension of power supply of the DC motor 2 (time: t0) to the constant speed rotation of the DC motor 2 (time: t15) through the stop of rotation and resumption of the power supply of the DC motor 2. The time period Ta is stored in the ROM 64. If it is determined that the predetermined time is not elapsed yet (S39: NO), the operation returns to Step S32. On the other hand, if it is determined that the predetermined time is elapsed (S39: YES), the encoder interrupt process is terminated.

If is determined in Step S36 that the printing in the encoder interrupt process relates to the second or a subsequent printing after the suspension of the power supply to the DC motor 2 (S36: YES)., the operation proceeds to Step S40, where it is determined if the power supply to the DC motor 2 is suspended. It should be noted that the second or a subsequent printing after the suspension of the power supply to the DC motor 2 is the time when the count of the forward rotation pulse counter 73 first reaches "10" as shown in FIG. 6A: time t2. If it is determined that the power supply to the DC motor 2 is suspended (S40: YES), the operation proceeds to Step S41. In Step S41, the count of the forward rotation pulse counter 73 is incremented by 1 and the operation proceeds to Step S37. In Step S37, dot printing of the printing line corresponding to the count of the printed line counter 75 is performed. Because of Step S41, the second or the subsequent printing in the encoder interrupt process is performed every time the count of the forward rotation pulse counter 73 is incremented by 4. Referring to FIG. 6A, the printing is performed when the count of the forward rotation pulse counter is "14": time t3).

If the power supply to the DC motor 2 is not suspended, or power is supplied to the DC motor 2 in this embodiment (S40: NO), the operation proceeds to Step S37.

If the timer shows 100 ms in Step S32 (S32: YES), an interrupt process after stop of the DC motor is performed in Step S42.

Figure 11:
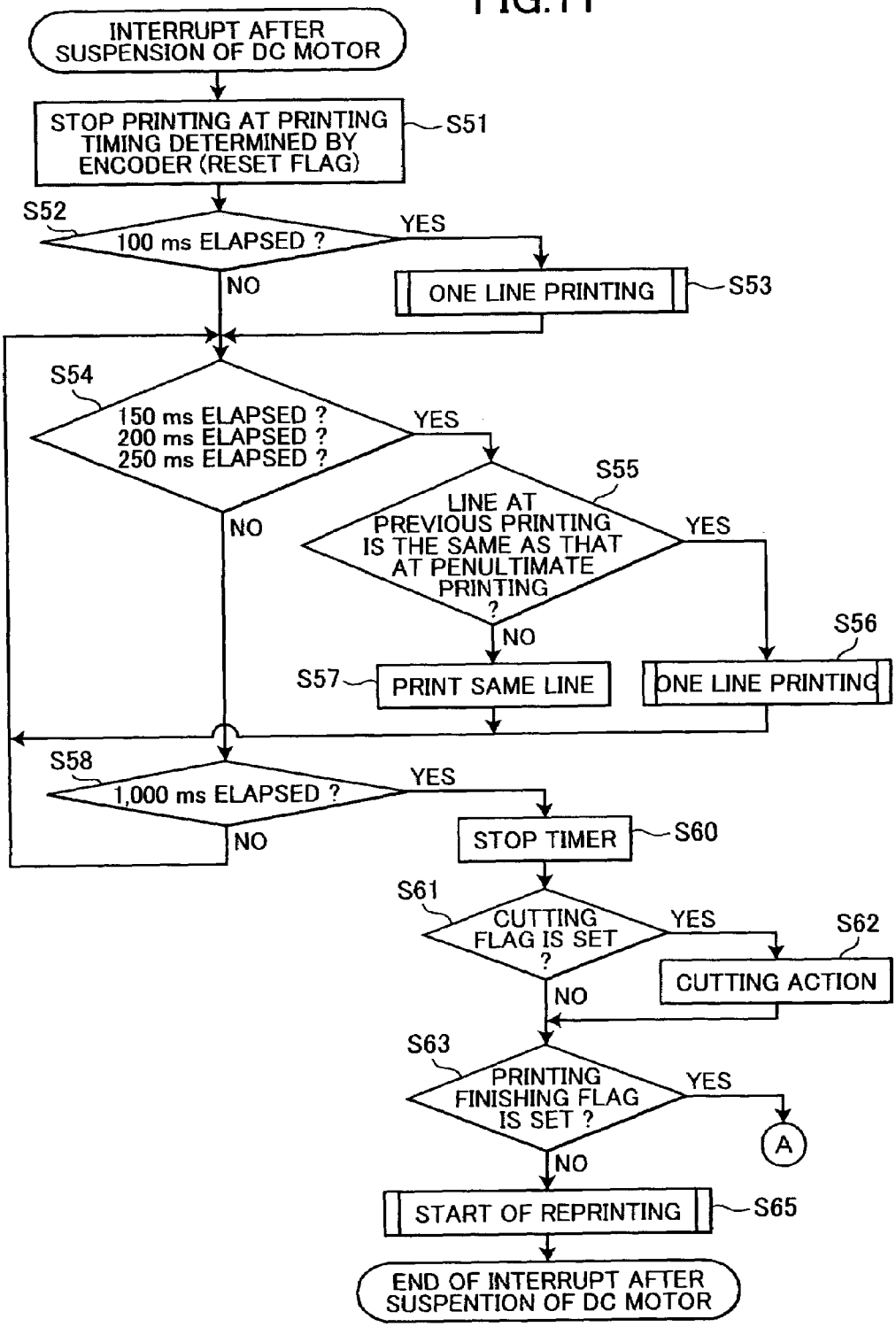
FIG. 11 is a flow chart illustrating an encoder interrupt after suspension of the DC motor.

FIG. 11 shows the interrupt process after stop of the DC motor. In Step S51, the flag set in Step S19 for the printing at the timing determined by the encoder 49 is reset. In the next Step S52, it is determined if the time elapsed after the suspension of the power supply to the DC motor 2 is 100 ms. If it is determined that the elapsed time is 100 ms (time: t4) (S52: YES), the operation proceeds to Step S53 for a line printing.

Figure 12:
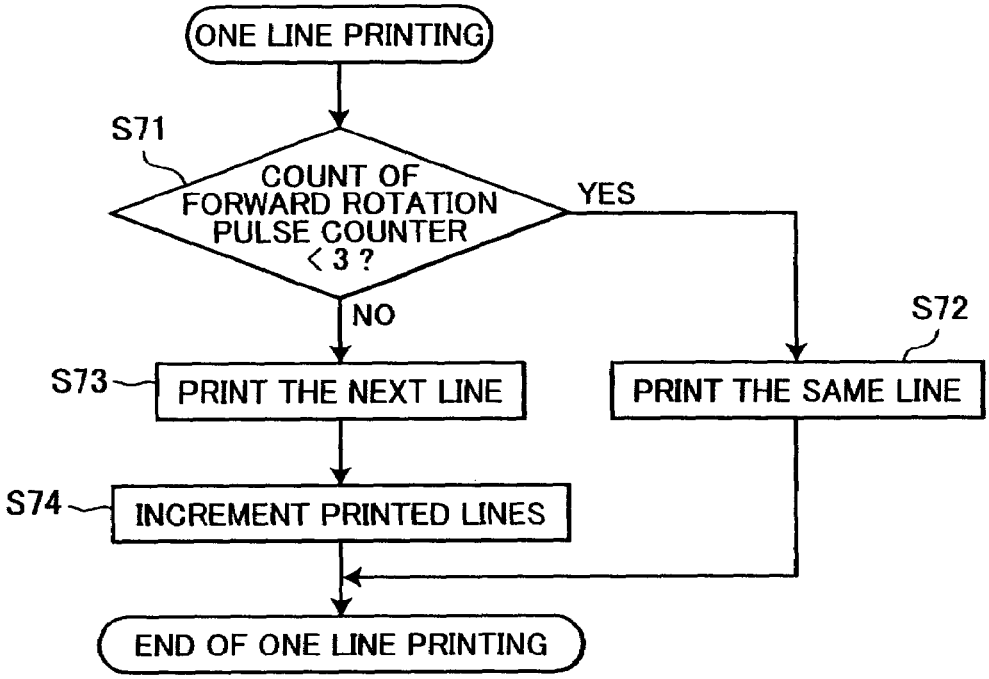
FIG. 12 is a flow chart of a line printing.

FIG. 12 showing the procedure of a line printing in Step S53. Firstly, in Step S71, it is determined if the increment of the count of the forward rotation pulse counter 73 from the previous printing is less than "3" or not. If the increment of the count value is less than "3" (S71: YES), the operation proceeds to Step S72. In Step S72, the same data as that of the line printed by the previous printing is printed on the surface layer tape 31 again. If the increment of the count value is equal to or more than "3" (S71: NO), the operation proceeds to Step S73. In Step S73, data of the next line to the line printed by the previous printing is printed on the surface layer tape 31, and the operation then proceeds to Step S74. In Step S74, the count of the printed line counter 75 is incremented by 1, and a line printing is terminated.

Figure 14A:
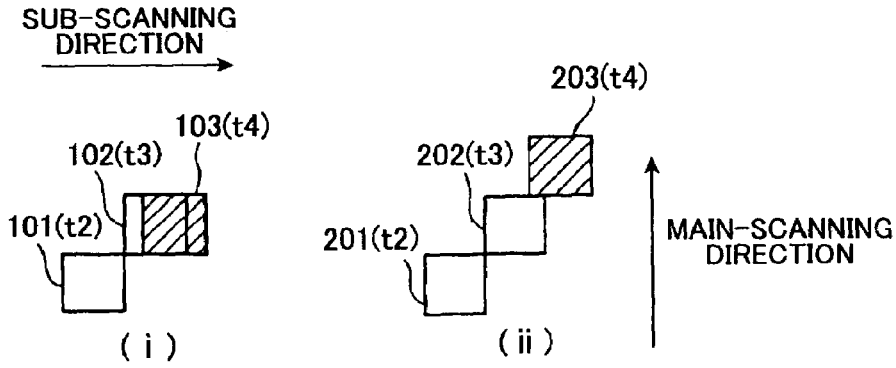
FIGS. 14A through 14D are schematic view showing patterns printed by the tape printer of FIG. 1.

The above operation will be described about the case in which thin inclined line having a width of a dot is printed, referring to FIG. 14. Assume that two dots 101, 102 or 201, 202 are already printed. When the same line is printed twice as described in Step S72, a new dot 103 is printed at the position shifted from the dot 102 in the sub-scanning direction by the distance corresponding to 0 to 3 pulses. However, the new dot 103 is printed at the same position in the main-scanning direction. It should be noted that the dot 102 is printed at the previous time, and that the sub-scanning direction is the same as the running direction of the tape, as shown in FIG. 14A(*i*). On the other hand, when a new line is printed as described in Step S73, a new dot 203 is printed at the position shifted from the dot 202 in the main-scanning direction by the distance corresponding to one pulse and in the sub-scanning direction by the distance corresponding to 3 to 5 pulses, as shown in FIG. 14A(*ii*). It should be noted that the dot 202 is printed in the previous printing.

If it is determined in Step S52 that the elapses time is not 100 ms (S52: NO), the operation proceeds to Step S54. In Step S54, it is determined which the time elapsed after the suspension of the supply of power to the DC motor 2 is 150 ms, 200 ms, or 250 ms. If it is determined that the elapsed time is one of 150 ms, 200 ms, and 250 ms (time t5, t6, or t7) (S54: YES), the operation proceeds to Step S55.

In Step S55, it is determined if the data of the same line as the line of the penultimate printing is printed on the surface layer tape 31 in the previous printing. If the data of the same line as the line of the penultimate printing is printed in the previous printing (S55: YES), the operation proceeds to Step S56, where a line printing is performed as performed in Step S53. If the data of the next line to the line of the penultimate printing is not printed in the previous printing (S55: NO), the operation proceeds to Step S57, where the data of the same line as the line of the previous printing is printed on the surface layer tape 31. By performing the processes of Step S53 and S55 through S57, the data for the same line or the data for the next line are selectively printed based on the amount of forward rotation of the DC motor 2 for each 50 ms interval after the suspension of the power supply to the DC motor 2 instead of sequentially changing data of a line for printing. Accordingly, when the power supply to the DC motor 2 is suspended, and the tape moves in the sub-scanning direction by a distance less than the interval between two dots printed at the constant speed, it is possible to avoid the printed image from having a remarkably narrow width.

If it is determined in Step S54 that the elapsed time is not any one of 150 ms, 200 ms, and 250 ms (S54: NO), the operation proceeds to Step S58. In Step S58, it is determined if the time elapsed after the suspension of the power supply to the DC motor 2 is 1,000 ms. If it is determined that the elapsed time is not 1,000 ms (S58: NO), the operation returns to Step S54. If it is determined that the elapsed time is 1,000 ms (time: t8) (S58: YES), the operation proceeds to Step S60.

In Step S60, the timer 67 is stopped. Then, in Step S61, it is determined if the cut flag is set in Step S3. If the cut flag is not set (S61: NO), no action is activated and the operation proceeds to Step S63. If the cut flag is set (S61: YES), the tape is cut in Step S62, and the operation proceeds to Step S63. As shown in FIG. 6A, when the tape is cut, the cut tape is moved downward by distance L1 due to the force applied by the cutter 17.

In Step S63, it is determined if the printing finishing flag is set in Step S15. If the printing finishing flag is set (S63: YES), the printing is terminated. If the printing finishing flag is set (S63: NO), the printing proceeds to Step S65 to perform a printing restart process. Then, the interrupting process is terminated.

Figure 13:
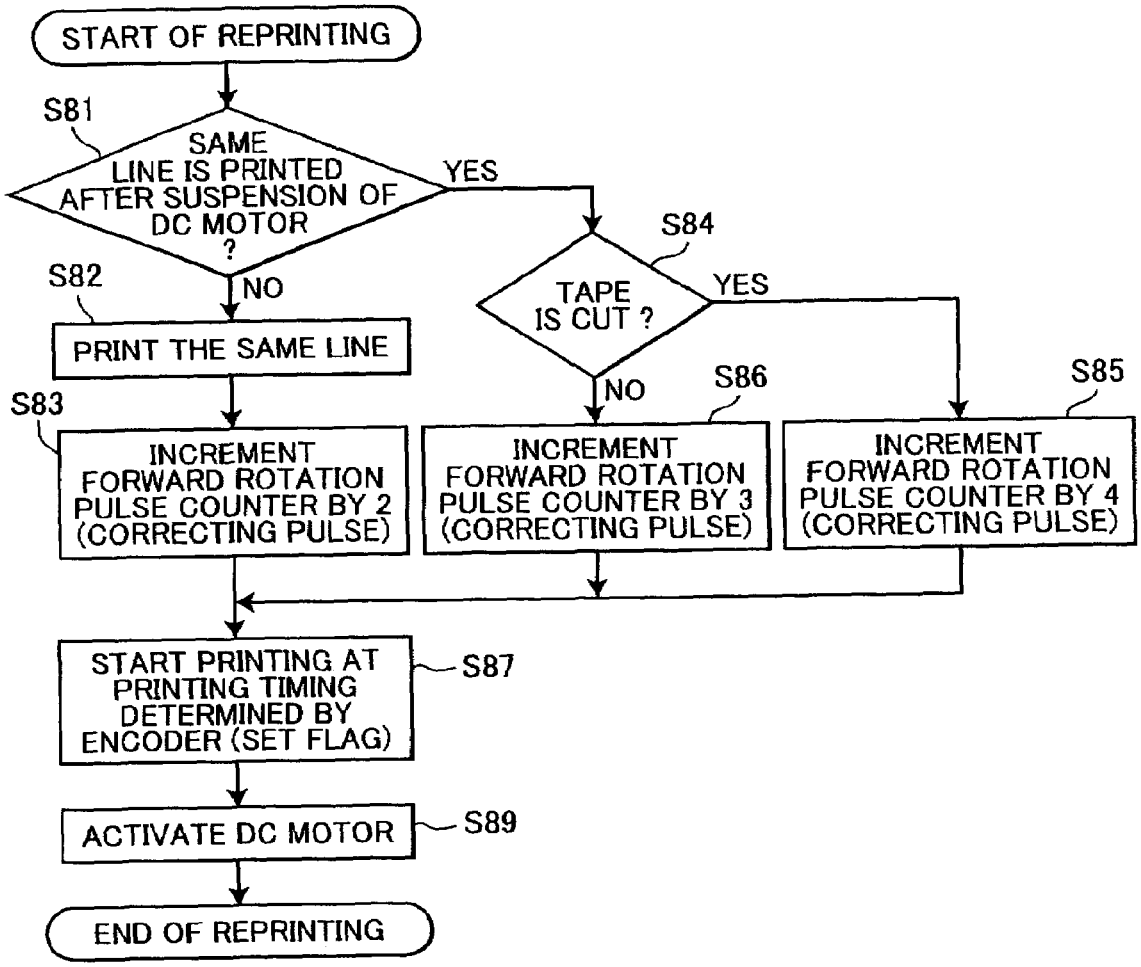
FIG. 13 is a flow chart of resuming a printing.

FIG. 13 illustrates an operation of the restarting printing procedure. When the power supply to the DC motor 2 is resumed, the reverse rotation of the DC motor 2 occurred from the suspension of the power supply of the DC motor 2 to the actual stop of the DC motor 2 is compensated. And then, data of a line is printed subsequently every time (5−a)+"the count of the forward rotation pulse counter 73 of the DC motor 2 detected by the encoder 49" is increased by five. It should be noted that "a" is a constant that is equal to 1 when the DC motor 2 is stopped and the tape is cut, or equal to 2 when the tape is not cut.

Figure 14B:
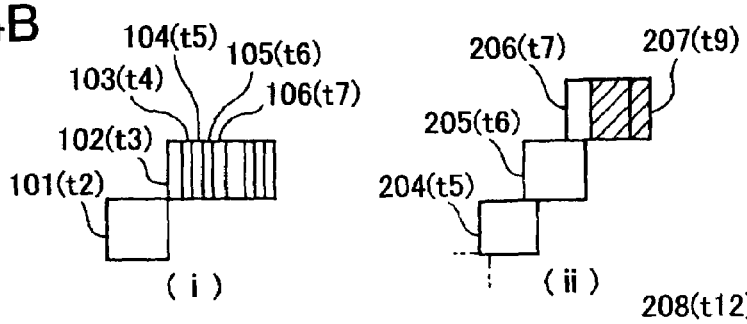

Firstly, in Step S81, it is determined if the data of the same line as the line of the previous printing is printed at all times t4, t5, t6, and t7 or only t7. It should be noted that times t4, t5, t6, and t7 correspond to 100 ms, 150 ms, 200 ms, and 250 ms, respectively. If it is determined that the data of printed lines are different from each other at all of t4, t5, t6, and t7 (S81: NO), the operation proceeds to Step S82. In Step S82, the data of the same line (dot 207: time t9) as the line of the previous printing (dot 206: time t7) is printed, assuming that the dot 204 is printed at time t5 and that the dot 205 is printed at time t6 as shown in FIG. 14B(*ii*). As a result, the printed dots are separated from each other in the sub-scanning direction by an amount of the movement of the tape in the case of the tape cutting. Therefore, it is possible to avoid the dot pitch from continuously reducing. It is also possible to avoid the line width of the printed image from narrowing. The operation then proceeds to Step S83. In Step S83, the count value of the forward rotation pulse counter 73 is incremented by "2". This increment is defined by considering the amount of tape movement between times t10 and t11 by the DC motor 2 in order to compensate the reverse rotation prior to the actual stop of the DC motor 2 (Step S44).

On the other hand, it is determined that the same line as that of the previous printing is printed at all of t4, t5, t6, and t7, the operation proceeds to Step S84. In other words, if the dot 103 printed at time t4, the dot 104 printed at time t5, the dot 105 printed at time t6, and the dot 106 printed at time t7 are located on the same position in the main-scanning direction, and displaced by the distance corresponding to 0 to 3 pulses in the sub-scanning direction, respectively, as shown in FIG. 14(B)(*i*) (S81: YES), the operation proceeds to Step S84. In Step S84, it is determined if a tape is cut or not. If a tape is cut (S84: YES), the operation-proceeds to Step S85. In Step S85, the above constant is set as 1, and the count of the forward rotation pulse counter 61*d* is incremented by "4". If a tape is not cut (S84: NO), the operation proceeds to Step S86. In step S86, the above constant is set as 2, and the count of the forward rotation pulse counter 61*d* is incremented by "3". The reason why different values are used depending on whether the tape is cut or not is that the tape is moved when the tape is cut. FIG. 14B shows the case in which the count of the forward rotation pulse counter 73 is not incremented regardless of the tape cutting. This is because the movement of the tape caused by the tape cutting is already considered at the printing of Step S82.

After completing Steps S83, S85 and S86, the operation proceeds to Step S87. In Step S87, the flag for starting an encoder interrupt procedure to print at the timing determined by the encoder 49 is set in a predetermined area of the RAM 66. Subsequently, in Step S89, the supply of power to the DC motor 2 is resumed, and the DC motor 2 starts rotating (time: t10). The restarting printing procedure is terminated.

After the completion of the operation of restarting printing process, the interrupt after the stop of DC motor is terminated so that the operation returns to the encoder interrupt procedure. Then, in Step S33, an encoder pulse count process is started. In this embodiment, the forward rotation of the DC motor 2 starts compensating the amount of reverse rotation of the DC motor 2 caused immediately before the actual stop of the DC motor 2 at time t10. In the encoder pulse count process, each time a forward rotation pulse is detected after the resumption of the power supply to the DC motor 2, the count of the reverse rotation pulse counter 74 is decremented by 1 so that the reverse rotation of the DC motor caused immediately before the suspend of the DC motor is compensated. If the DC motor 2 rotates in Step S45 in order to compensate the amount of the reverse rotation in the encoder pulse count processing operation, the tape is actually moved ahead by distance L2. In Step S43, when the count of the reverse rotation pulse counter 74 is not 0, the encoder pulse counting is only performed and printing is not performed by the thermal head 13.

Figure 14C:
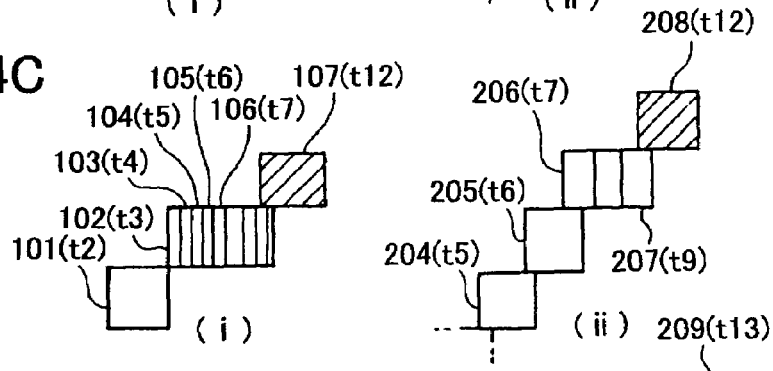

In Step S43, after the count of the reverse rotation pulse counter 74 reaches 0, and the amount of the reverse rotation of the DC motor 2 is compensated with the amount of the forward rotation after the resumption of the power supply to the DC motor 2, the timing of printing the data of the line is controlled again based on the increment in the count of the forward rotation pulse counter from time t11. Time t11 is the time when a forward rotation pulse is first counted after the resumption of the power supply to the DC motor 2 in Step S44. At time t11, the count of the forward rotation pulse counter 73 is incremented by 2, 3, or 4 from a multiple of 5 depending on Steps S83, S86 or S85, respectively. Therefore, time t12 of the first printing after the resumption of the power supply to the DC motor is at the moment when three forward rotation pulses are counted in Step S83. When the operation passes through Step S85, time t12 is the moment when two forward rotation pulses are counted. When the operation passes through Step S86, t12 is the moment when one forward rotation pulse is counted (time t11 in FIG. 6A). FIG. 14C(*i*) and (*ii*) show the dots 107, 208 printed at time t11, respectively.

Figure 14D:
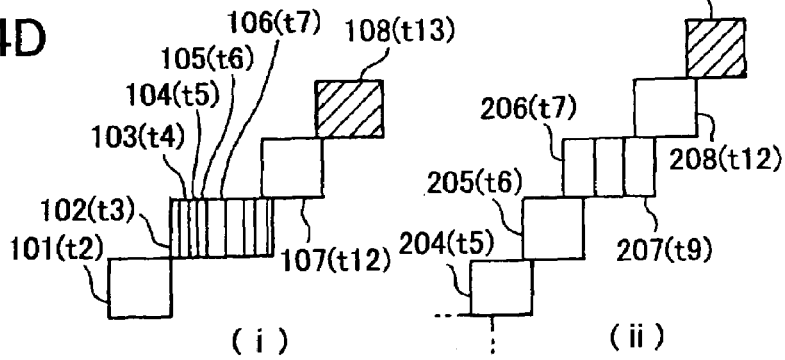

The second printing after the resumption of the power supply to the DC motor 2 is performed at time t12 when five forward rotation pulses are counted as the encoder pulse counting after time t11. FIG. 14D(*i*) and (*ii*) show dots 108, 208 printed at this time, respectively. Thereafter, in Step S39, a printing is performed each time the count of the forward rotation pulse counter 73 is incremented by 5, until the count of the timer, the time elapsed after the stop of the power supply to the DC motor 2, reaches a predetermined time Ta. The count of the printed line counter is then incremented by 1 (time t13, time t14, time t15). Then, if it is determined in Step S39 that the predetermined time Ta elapses after the stop of the power supply to DC motor 2 (time t15), the encoder interrupt is terminated and the operation returns to Step S11. In other words, in this embodiment, it is considered that the DC motor 2 starts rotating at the constant speed at time t15. The printing cycle timer restarts, and the printing is then performed at the predetermined time interval T0.

In this way, in the tape printer 1 of this embodiment, the encoder 49 detects the amount of reverse rotation of the DC motor 2. Based on this detection, the displacement of the dots printed caused by the reverse rotation of the DC motor 2 during a time period from the suspension of the power supply of the DC motor 2 to the actual stop of the DC motor 2 is suppressed. Therefore, printed adjacent dots are properly continuous to each other, which results in a high quality printing. Furthermore, the encoder 49 detects the amount of forward rotation of the DC motor 2. Based on this detection, the tape printer 1 controls the printing. Displacement of the printed dots can be reliably prevented compared with an arrangement in which a printing timing is determined based on the time elapsed after the suspension of the power supply to the DC motor 2.

Additionally, a printing is performed when the count of the forward rotation pulse counter is incremented not by five but by four immediately before the stop of the DC motor 2. This arrangement avoids the amount of actual movement of the tape from exceeding the amount of movement caused by the rotation of the DC motor 2. Therefore, displacement of printed dots is prevented accurately. In addition, during time period from 100 ms to 250 ms, either one of data of the same printing as the previous one and data of the next line to the previous one is selected depending on the amount of forward rotation of the DC motor 2 for 50 ms. Accordingly, printed lines have a uniform width.

Furthermore, when the data of the next line is printed after the time elapse of 250 ms, the data of the same line as that of the previous printing is printed again after the tape is cut. With this arrangement, a first printing after the resumption of the power supply to the DC motor 2 is performed when the amount of forward rotation of the DC motor 2 is less than five pulses. If the movement of the recording medium in the transfer direction due to the tape cutting does not match the actual movement of the tape transferred by the feeding mechanism in order to compensate the amount of reverse rotation of the DC motor 2, a white line may be caused. However, the above arrangement can prevent the occurrence of the white line. In this case, the first printing after resumption of power supply to the DC motor 2 is performed considering the presence/absence of the tape cutting. Therefore, it is possible to provide high quality image printing without substantial displacement of dots.

Additionally, a printing is performed at the predetermined time intervals T0 regardless of the output of the encoder 49 when the DC motor 2 rotates at a constant speed. Therefore, even when the DC motor 2 rotates at a high constant speed, a sufficient time period is secured for a data process required during a time period the thermal head 13 is stopped. As a result, printing error can be avoided, and high quality images are printed. Additionally, in this embodiment, the electronic governor circuit is used in order to reduce fluctuations in rotations of the DC motor 2. The electronic governor circuit assists substantially constant speed rotation of the DC motor 2. Thus, the intervals of the dot printed at the time interval T0 are reliably maintained constant, and the quality of the printed image is improved.

It should be noted that that the number of pulses described in the above embodiment is only example and can be modified appropriately depending on the structure of the printer and the type of tape. Preferably, the ROM 64 of the tape printer 1 may store tables containing a lot of combinations of the above numbers of pulses. With such an arrangement, a specific combination of the numbers of pulses may be selectively used to optimize the printing effect depending on a type of tape and operating conditions.

The present invention provides the following advantages.

In the above tape printer 1, the thermal head 13 is driven to print at predetermined time intervals when the DC motor 2 rotates at a constant speed. Therefore, the ROM 64 stores data on intervals (T0) at which the thermal head 13 is energized while the tape is running at a constant speed. Thus, because the thermal head 13 is driven at predetermined time intervals during the constant speed rotation of the DC motor 2, a sufficiently time period is secured for a data process for data printed during the time period the thermal head 13 is at rest (for example, development of outline font data into bit map data, character ornamentation, conversion between vertical lines and horizontal lines) even when the DC motor 2 rotates at a high constant speed. As a result, deterioration in printed image such as printing error can be avoided.

On the other hand, when the DC motor 2 does not rotate at a constant speed (in the time period from the suspension of the power supply of the DC motor 2 to the actual stop of the DC motor 2 actually stops, and the time period from the resumption of the power supply of the DC motor 2 to the constant-speed rotation of the DC motor 2), the thermal head 13 performs the printing, every time the amount of forward rotation of the DC motor 2 is increased by a predetermined amount according to the output signal of the photo-sensors 49*b*, 49*c* of the encoder 49. Because the encoder 49 is used to determine the timing of driving the thermal head 13 when the DC motor 2 does not rotate at a constant speed, any displacement of printed dots can be reliably prevented, compared with an arrangement of determining the timing of printing based on the time elapsed after the suspension of the supply of power to the DC motor 2, for instance.

Additionally, when the DC motor rotates reversely during a time period from the suspension of the power supply to the DC motor 2 to the stop of rotation of the DC motor 2, the amount of the reverse rotation is detected by the encoder 49. The timing of driving the thermal head 13 is controlled in such a way that the amount of reverse rotation of the DC motor 2 is compensated at the time of the resumption of the power supply to the DC motor 2. More specifically, if the DC motor 2 rotates reversely immediately before it stops, the DC motor 2 first rotates forward by an angle equal to the amount of reverse rotation after the resumption of the power supply. And then the thermal head 13 is driven every time the amount of the forward rotation of the DC motor 2 is increased by a predetermined amount. With this arrangement, it is possible to effectively suppress the displacement of the printed dots caused by the reverse rotation of the DC motor 2 during the period from the suspension of the power supply to the stop of the DC motor 2. Therefore, printed adjacent dots are properly connected to each other to improve printing quality.

Furthermore, in the above tape printer 1, the following control is performed in order to obtain good quality printing before and after the suspension of the DC motor 2.

(a) After the suspension of the power supply to the DC motor 2, the thermal head 13 is driven at every five pulses until the count of the forward rotation pulses detected by the encoder 49 reaches ten. Thereafter, the thermal head 13 is driven at every four pulses. With this arrangement, the excess amount of movement of the tape over the amount of rotary movement of the DC motor 2 immediately before the actual stop of the DC motor 2 is compensated to reliably prevent displacement of printed dots.

(b) After the suspension of the power supply to the DC motor 2, (i) if the increment of the count of forward rotation pulse is less than "3" when 100 ms, 150 ms, 200 ms or 250 ms have elapsed, the thermal head 13 is driven in order that data of the same line as the line of the previous printing is printed at that time. (ii) if the increment is equal to or more than three, data of the next line to the line of the previous printing is printed at that time. This arrangement selectively prints the data of the same line or the data of the next line, depending on the amount of forward rotation during each certain time period. Therefore, it is possible to prevent the line-width of the printed image from being extremely different from the original line-width of the original image, because the printing medium moves even if the DC motor stops.

(c) (ii) If the increment of the count of the forward rotation pulse is equal to or more than 3 when 250 ms elapsed after the suspension of the power supply to the DC motor 2, and the data for the next line is printed, The thermal head 13 is driven in order to print the data for the next line again after the cutting of the tape. (i) if the increment is less than 3, no operation is performed after the cutting of the tape. With this arrangement, after the data for the next line is printed after the elapse of 250 ms, the data for the next line is printed again at the position the tape is moved along its running direction due to the cutting of the tape. Thus, if the tape is not moved by a normal amount (that corresponds to 5 pulses) so that the pitch between the printed dots is reduced, the reduced pitch is cancelled by longer pitch of printed dots that are produced due to the advancement of the tape after the cutting. Therefore, a narrower line width of the printed image can be effectively suppressed. This approach is not performed when the data for the same line are printed at the time 250 ms elapsed, because the pitch between the printed dots is wider.

(d) when the power supply to the DC motor 2 is resumed, and the same data is printed as described in (i) at the time of 250 ms elapsed after the suspension of power supply to the DC motor, the amount of reverse rotation of the DC motor 2 during the time period from the suspension of power supply to the DC motor 2 to the actual stop of the DC motor 2 actually stops is compensated. The thermal head 13 is then driven in such a way that the data of the next line is printed each time (5−a)+"the amount of forward rotation detected by the encoder 49" (a is a constant that is 1 in the case the tape is cut when the DC motor 2 is stopped, or 2 in the case the tape is not cut) is increased by five. When the data for the next line is printed at the time of 250 ms elapsed after the suspension of the power supply to the DC motor 2 as described in (ii), the amount of reverse rotation of the DC motor 2 during the time period from the suspension of power supply to the DC motor 2 to the stop of the DC motor 2 is compensated. And then the data for the next line is printed after the amount of forward rotation of the DC motor 2 is increased by three pulses. Thereafter, the thermal head 13 is driven in such a way that the data for the next line is printed every time the amount of forward rotation of the DC motor 2 is increased by five pulses. With this arrangement, the first printing after the resumption of power supply to the DC motor 2 is performed when the increment of forward pulse by the DC motor 2 is less than five. Therefore, a white line caused by the difference between the movement of the tape in the running direction generated by the tape cutting (L1 in FIG. 6A) and the actual movement of the tape caused by the DC motor 2 for the compensation of the reverse rotation (L2 in FIG. 6A) is suppressed. Accordingly, joint of the printed image before and after the resumption of the supply of power to the DC motor 2 is improved. Additionally, the value of the constant; a is changed depending on if the tape is cut after the stop of the DC motor 2. Thus, dots can be printed at proper positions, considering the movement of the tape caused by the tape cutting.

While the preferred embodiment of the present invention is described, the present invention is not limited to the above embodiment. A lot of modifications come under the scope of the present invention. Additionally, in the above embodiment, the thermal head is used as printing head. However, any types of printing head except the thermal head may be used. In the above embodiment, the example in which the tape is cut during the suspension of the printing is described. However, it is within the scope of the present invention that the printing is suspended due to a large volume of printing data, and the rest of the data is entered during the suspension of the printing.

In the above described embodiment, the printing timing is determined without using the encoder during the time period from t3 to t11 in which the DC motor does not rotate at a constant speed and has a small number of revolution. Alternatively, the printing timing may be determined according to the output pulses of the encoder when the printing medium is not moving at a constant speed (time t0 to time t15) including the time period between time t3 and time t11.

In the above described embodiment, the printing head is fixed and the tape is moved by a DC motor. Alternatively, the tape may be fixed, and the printing head may be moved by the DC motor. The tape may not be necessarily a multilayer tape such as a two-layered tape. In other words, the printing may be performed on a surface layer tape, and then the surface layer tape itself may be ejected. Furthermore, any device except an encoder may be used for detecting forward and backward rotations of the DC motor.

INDUSTRIAL APPLICABILITY

This invention is applicable to any type of tape printer driven by a DC motor.

What is claimed is:

1. A tape printer, comprising:

a printing head that prints a dot pattern on a printing medium on a line basis, the printing medium having a tape shape;

a feed mechanism that relatively moves one of the printing medium and the printing head against the other;

a direct current motor that drives the feed mechanism;

forward rotation detection means that detects an amount of forward rotation of the direct current motor; and printing control means that controls a driving timing of the printing head; wherein during at least a part of a period from a suspension of power-supply of the direct current motor to a start of constant-speed rotation of the direct current motor through a stop of the direct current motor and a resumption of the power supply of the direct current motor, the printing control means prints data related on a line sequentially every time the amount of forward rotation of the direct current motor detected by the forward rotation detection means increases by a predetermined amount, and wherein during a period of a constant rotation of the direct current motor, the printing control means prints data related on a line at predetermined intervals.

2. The tape printer according to claim 1, further comprising reverse rotation detection means that detects an amount of reverse rotation of the direct current motor, wherein the printing control means controls the driving timing of the printing head after the resumption of the power supply to the direct current motor so as to compensate the amount of reverse rotation of the direct current motor detected by the reverse rotation detection means during a period from the suspension of power supply of the direct current motor to the stop of the direct current motor.

3. The tape printer according to claim 1, further comprising fluctuation reduction means that reduces a fluctuation in the rotation of the direct current motor.

4. A tape printer, comprising:

a printing head that prints a line including a dot pattern arranged in a width direction of a printing medium having a tape shape;

a feed mechanism that moves either one of the printing medium and the printing head against the other, the feed mechanism including a direct current motor;

printing control means that controls driving of the printing head and the motor; and forward rotation detection means that detects an amount of forward rotation of the direct current motor; wherein during a period from suspension of power supply to the direct current motor to a start of constant-speed rotation of the direct current motor through a stop of rotation of the direct current motor and a resumption of power supply to the direct current motor, the control means prints a line sequentially every time the amount of forward rotation of the direct current motor detected by the forward rotation detection means increases by a predetermined amount, and wherein during a period of constant-speed rotation of the direct current motor, the printing control means prints the line at predetermined time intervals.

5. The tape printer according to claim 2, further comprising fluctuation reduction means that reduces a fluctuation in the rotation of the direct current motor.

6. A tape printer, comprising:

a printing head that prints a line including a dot pattern arranged in a width direction of a printing medium having a tape shape;

a feed mechanism that moves either one of the printing medium and the printing head against the other, the feed mechanism including a direct current motor;

printing control means that controls driving of the printing head and the motor;

forward rotation detection means that detects an amount of forward rotation of the direct current motor; wherein during a period from suspension of power supply to the direct current motor to a start of constant-speed rotation of the direct current motor through a stop of rotation of the direct current motor and a resumption of power supply to the direct current motor, the control means prints a line sequentially every time the amount of forward rotation of the direct current motor detected by the forward rotation detection means increases by a predetermined amount, and wherein during a period of constant-speed rotation of the direct current motor, the printing control means prints the line at predetermined time intervals; and reverse rotation detection means that detects an amount of reverse rotation of the direct current motor, wherein the printing control means controls the driving timing of the printing head after the resumption of the power supply to the direct current motor so as to compensate the amount of reverse rotation of the direct current motor detected by the reverse rotation detection means during a period from the suspension of power supply of the direct current motor to the stop of the direct current motor.

7. A tape printer, comprising:

a printing head that prints a dot pattern on a printing medium on a line basis, the printing medium having a tape shape;

a feed mechanism that relatively moves one of the printing medium and the printing head against the other;

a direct current motor that drives the feed mechanism;

forward rotation detection means that detects an amount of forward rotation of the direct current motor;

printing control means that controls a driving timing of the printing head; wherein during at least a part of a period from a suspension of power-supply of the direct current motor to a start of constant-speed rotation of the direct current motor through a stop of the direct current motor and a resumption of the power supply of the direct current motor, the printing control means prints data related on a line sequentially every time the amount of forward rotation of the direct current motor detected by the forward rotation detection means increases by a predetermined amount, and wherein during a period of a constant rotation of the direct current motor, the printing control means prints data related on a line at predetermined intervals; and reverse rotation detection means that detects an amount of reverse rotation of the direct current motor, wherein the printing control means controls the driving timing of the printing head after the resumption of the power supply to the direct current motor so as to compensate the amount of reverse rotation of the direct current motor detected by the reverse rotation detection means during a period from the suspension of power supply of the direct current motor to the stop of the direct current motor.

* * * * *